US005971907A

United States Patent [19]

Johannemann et al.

[11] Patent Number: 5,971,907

[45] Date of Patent: Oct. 26, 1999

[54] CONTINUOUS CENTRIFUGAL SEPARATOR WITH TAPERED INTERNAL FEED DISTRIBUTOR

[75] Inventors: John A. Johannemann, Madison; Richard C. Albano, Morgan; Gaines L. Brewer, Lawrence, all of Ala.

[73] Assignee: BP Amoco Corporation, Chicago, Ill.

[21] Appl. No.: 09/081,232

[22] Filed: May 19, 1998

[51] Int. Cl.[6] ..... B04B 1/20

[52] U.S. Cl. ..... 494/37; 494/53

[58] Field of Search ..... 494/50–54, 37; 210/377, 380.1, 380.3

[56] References Cited

U.S. PATENT DOCUMENTS

| | | | |
|---|---|---|---|
| 3,177,265 | 4/1965 | Lammers . | |
| 3,187,997 | 6/1965 | Gooch | 494/53 |
| 3,228,594 | 1/1966 | Amero . | |
| 3,423,015 | 1/1969 | O'Conor . | |
| 3,423,016 | 1/1969 | Heckmann | 494/53 |
| 3,447,742 | 6/1969 | Ericksson et al. . | |
| 3,462,509 | 8/1969 | Dresser et al. . | |
| 3,501,346 | 3/1970 | Katzen et al. | 494/53 |
| 3,568,919 | 3/1971 | Nielsen | 494/53 |
| 3,568,920 | 3/1971 | Nielsen | 494/53 |
| 3,720,647 | 3/1973 | Gelbe et al. . | |
| 3,723,558 | 3/1973 | Kramer . | |
| 3,795,361 | 3/1974 | Lee . | |
| 3,971,509 | 7/1976 | Johnsen . | |
| 4,313,559 | 2/1982 | Ostkamp et al. . | |
| 4,496,340 | 1/1985 | Redeker et al. . | |
| 4,654,022 | 3/1987 | Shapiro . | |
| 4,714,456 | 12/1987 | Bender et al. | 494/53 |
| 4,721,825 | 1/1988 | Oda et al. . | |
| 4,731,182 | 3/1988 | High . | |
| 5,004,860 | 4/1991 | Hansen et al. . | |
| 5,182,020 | 1/1993 | Grimwood . | |
| 5,374,234 | 12/1994 | Madsen | 494/53 |
| 5,448,005 | 9/1995 | Eccli et al. . | |
| 5,498,822 | 3/1996 | Eccli et al. . | |
| 5,653,673 | 8/1997 | Desai et al. | 494/37 |

FOREIGN PATENT DOCUMENTS

| | | | |
|---|---|---|---|
| 640398 | 3/1995 | European Pat. Off. | 494/53 |
| 3518885 | 11/1986 | Germany | 494/53 |
| 63-194759 | 8/1988 | Japan | 494/53 |
| 481680 | 10/1970 | Switzerland | 494/53 |
| 358016 | 11/1972 | U.S.S.R. | 494/53 |
| 561574 | 6/1977 | U.S.S.R. | 494/53 |
| 564885 | 7/1977 | U.S.S.R. | 494/53 |
| 1194498 | 11/1985 | U.S.S.R. | 494/53 |
| 1660759 | 7/1991 | U.S.S.R. | 494/53 |
| 93/10906 | 6/1993 | WIPO | 494/53 |

*Primary Examiner*—Charles E. Cooley

*Attorney, Agent, or Firm*—Mary Jo Kanady; Wallace L. Oliver

[57] ABSTRACT

Improved centrifugal decanters with a screw conveyor for the continuous separation of solids-liquid mixtures are disclosed wherein the conveyor is provided with a feed arrangement for reducing the magnitude of mechanical vibrations of the centrifuge comprising a coaxially mounted feed distributor, generally trunco-conical in form, adapted to distribute into the conveyor, a solids-liquid feed stream falling into the distributor from a short stationary feed tube. The invention includes processes which use such improved centrifuge apparatus for continuous separation of solids-liquid mixtures into separate components by centrifugal action.

17 Claims, 3 Drawing Sheets

CONTINUOUS CENTRIFUGAL SEPARATOR WITH TAPERED INTERNAL FEED DISTRIBUTOR

TECHNICAL FIELD

The present invention relates to apparatus for continuous separation of solids-liquid mixtures by decantation enhanced by centrifugal forces to rapidly separate feed mixtures into layers of light and heavy phase materials which are discharged separately from a rotating centrifuge bowl in which a screw conveyor revolves at a slightly different speed. It is the function of the screw conveyor to move the outer layer of heavy sedimented solids to a discharge port thereof, usually located in a tapered or conical end portion of the bowl, while allowing the inner layer of light liquid to overflow from the bowl end opposite the solids discharge port. More particularly, the conveyor is provided with a coaxially mounted feed distributor of generally trunco-conical form adapted to distribute solids-liquid mixtures into the rotating centrifuge bowl.

Another aspect of the invention includes processes which use such improved centrifuge apparatus for continuous separation of solids-liquid mixtures into separate components by centrifugal action. This invention provides, for example, improved separation of mother liquor from small crystalline solids to achieve desired purity of recovered solid product. Processes of purification according to this invention are particularly useful where the impure organic compound being purified is an aromatic compound such as para-xylene, terephthalic acid formed by the oxidation of para-xylene, isophthalic acid formed by the oxidation of meta-xylene, or 2,6-naphthalene dicarboxylic acid formed by the oxidation of a 2,6-dialkylnaphthalene. Improved centrifuge apparatus of the invention is also used advantageously to reduce costs of maintenance for continuous separation of insoluble solids from liquid mixtures, such as dewatering an aqueous slurry of crushed coal.

BACKGROUND OF THE INVENTION

Centrifuge decanters are well known. Such apparatus typically comprises an elongated bowl mounted for rotation about its longitudinal axis, with a helical screw conveyor coaxially mounted within the bowl, adapted to rotate at a speed slightly different than the rotational speed of the bowl. The bowl is tapered or trunco-conical near its solids discharge end. The screw conveyor is formed of one or more helically arranged blades which sweep the surface of the bowl of the apparatus while propelling the centrifugally sedimented solids toward the solids discharge port. The inner layer of light liquid is discharged from the liquid pool through overflow ports in the bowl end, opposite the solids discharge ports.

In operation of a centrifuge decanter with a screw conveyor, a solids-liquid feed is introduced into a middle portion of the bowl, where, due to centrifugal force effected by rotation of the bowl, the feed separates into its component parts with the heavier part, typically solids, being moved outward from the other feed components in a pool of liquid and adjacent to the inner surface of the bowl. Since the bowl and screw conveyor are rotated at predetermined different speeds, solids sedimented against the inner surface of the bowl are conveyed by the distal edge of the conveyor's blade along the bowl surface until separated from the pool of liquid and discharged from one or more ports at the tapered end of the bowl.

O'Conor in U.S. Pat. No. 3,423,015 described horizontal type continuous centrifugal separators including stationary pipes extending axially into the rotating element of the conveyor assembly for discharging feeds therein. Other horizontal centrifuge apparatus with extended stationary feed pipes are described, for example, in U.S. Pat. Nos. 3,228,594 to Amero; 3,447,742 to Eriksson et al.; 3,795,361 to Lee; 3,971,509 to Johnsen; 4,313,559 to Ostkamp et al.; 4,496,340 to Redeker et al.; 4,654,022 to Shapiro, 4,731,182 to High; and 5,182,020 to Grimwood.

Commercially important uses of centrifuge decanters include separation of solid crystalline chemical compounds from liquids under process conditions which do not degrade quality such as chemical purity of a desired crystalline product. Crystallization, as a commercial process, is significant because of the great variety of materials that are marketed in the crystalline form. Its wide use is due basically to the fact that a crystal forming from an impure solution is itself generally pure. Thus, crystallization affords a practical method of obtaining concentrated chemical substances in a form both pure and attractive, and in suitable condition for packaging, handling, and storing.

Solid particulate or crystalline products are handled and marketed more conveniently and economically than products in solution. Separations of a particulate solid or crystalline phase from a liquid phase by cooling, evaporation, or both, are well known. For example, separation of salt from sea water by solar-evaporation may be prehistoric.

Crystallization is also important in the preparation of a pure product since a crystal usually separates out as a substance of definite composition from a solution of varying composition. Impurities in the mother liquor are carried in the crystalline product only to the extent that they adhere to the surface or are occluded within crystals which may have grown together during crystallization.

Many organic compounds are formed by chemical reactions in a liquid phase, or are at least sparingly soluble in liquid solvents. To purify such compounds by means involving treating solutions of them and/or recovering solid product from a liquid phase requires some means of crystallization. Aromatic dicarboxylic acids are, for example, well known starting materials for making polyester resins, which polyester resins are used widely as principal polymers for polyester fibers, polyester films, and resins for bottles and like containers. For a polyester resin to have properties required in many of these uses, the polyester resin must be made from a polymer grade or "purified" aromatic acid. Polymer grade or purified terephthalic acid and isophthalic acid are the starting materials for polyethylene terephthalates and isophthalates, respectively, which are the principal polymers employed in the manufacture of polyester fibers, polyester films, and resins for bottles and like containers. Similarly, polymer grade or "purified" naphthalene dicarboxylic acids, especially 2,6-naphthalene dicarboxylic acid, are the starting materials for polyethylene naphthalates, which can also be employed in the manufacture of fibers, films and resins.

Commonly assigned U.S. Pat. No. 3,497,552 to Olsen discloses that purification of impure organic compounds sparingly soluble in a liquid such as water can be accomplished by continuous crystallization in a plurality of series-connected cooling stages using dilutions by cooled solvent of feed at each stage.

A purified terephthalic acid, isophthalic acid or naphthalene dicarboxylic acid can be derived from a relatively less pure, technical grade or "crude" terephthalic acid, isophthalic acid or "crude" naphthalene dicarboxylic acid, respectively, by purification of the crude acid utilizing hydrogen and a noble metal catalyst as described for terephthalic acid in commonly assigned U.S. Pat. No. 3,584,039 to Meyer. In the purification process of Meyer, impure terephthalic acid, isophthalic acid or naphthalene dicarboxylic acid is dissolved in water or other suitable solvent or solvent mixture at an elevated temperature, and the resulting solution is hydrogenated, preferably in the presence of a hydrogenation catalyst, which conventionally is palladium on a carbon support, as described in commonly assigned U.S. Pat. No. 3,726,915 to Pohlmann. This hydrogenation step converts the various color bodies present in the relatively impure phthalic acid or naphthalene dicarboxylic acid to colorless products. Another related purification-by-hydrogenation process for aromatic polycarboxylic acids produced by liquid phase catalyst oxidation of polyalkyl aromatic hydrocarbons is described in commonly assigned U.S. Pat. No. 4,405,809 to Stech et al.

Aromatic carboxylic acids are useful chemical compounds and are raw materials for a wide variety of manufactured articles. For example, terephthalic acid is manufactured on a world-wide basis in amounts exceeding 10 billion pounds per year. A single manufacturing plant can produce 100,000 to more than 750,000 metric tons of terephthalic acid per year. Terephthalic acid is used, for example, to prepare polyethylene terephthalate, a raw material for manufacturing polyester fibers for textile applications and polyester film for packaging and container applications. Terephthalic acid can be produced by the high pressure, exothermic oxidation of a suitable aromatic feedstock compound, such as para-xylene, in a liquid-phase reaction using air or other source of dioxygen (molecular oxygen) as the oxidant and catalyzed by one or more heavy metal compounds and one or more promoter compounds.

Methods for oxidizing para-xylene and other aromatic compounds using such liquid-phase oxidations are well known in the art. For example, Saffer in U.S. Pat. No. 2,833,816 discloses a method for oxidizing aromatic feedstock compounds to their corresponding aromatic carboxylic acids. Other processes are disclosed in U.S. Pat. Nos. 3,870,754; 4,933,491; 4,950,786; and 5,292,934. A particularly preferred method for oxidizing 2,6-dimethylnaphthalene to 2,6-naphthalenedicarboxylic acid is disclosed in U.S. Pat. No. 5,183,933. Central to these processes for preparing aromatic carboxylic acids is employment of an oxidation catalyst comprising a heavy metal component and a source of bromine in a liquid-phase reaction mixture, including a low molecular weight monocarboxylic acid such as acetic acid, as part of the reaction solvent. A certain amount of water is also present in the oxidation reaction solvent, and water is also formed as a result of the oxidation reaction.

Although petroleum, more particularly reformate fractions produced in petroleum refining, provides a valuable source of para-xylene, separation of the para-xylene from associated, close boiling hydrocarbons presents a difficult commercial problem. Some areas of the chemical market require a para-xylene of at least 98% purity, which means it cannot be recovered by fractional distillation or simple crystallization in reasonable enough yield for economic feasibility. There have been a number of approaches to the problem, using fractional crystallization, for example, but the high cost of the available processes in terms of equipment and operational expense makes further simplification highly desirable. Any improvement in ultimate yield improves the economic attractiveness of the process and reduces the unit cost.

Methods for separation of para-xylene from other aromatic compounds by crystallization are well known in the art. For example, G. C. Lammers in U.S. Pat. No. 3,177,265 discloses a particularly efficient method for recovering para-xylene by crystallization from a C8 or mixed xylene feed which utilizes a two-stage crystallization process with centrifugal separation following each stage. By use of this method 98+% para-xylene product is obtainable. It has been further found that stepwise cooling in the first stage facilitates crystal growth which enhances ease of separation of the mother liquor from crystal cake. Other processes are disclosed in U.S. Pat. Nos. 3,462,509 to Dresser et al.; 3,720,647 to Gleb et al.; 3,723,558 to Kramer; 4,721,825 to Oda et al.; 5,448,005 and 5,498,822 to Eccli et al.

Extraction of high purity para-xylene crystals from a feed of mixed xylenes and impurities has included the steps of cooling a feed of mixed xylenes and impurities in a crystallization stage to crystallize out para-xylene, separating the liquid component comprising ortho-xylene and meta-xylene and impurities from the solid crystal para-xylene in a centrifuge to obtain high purity para-xylene, supplying the mixed liquid (xylenes and impurities) filtrate, including para-xylene melted due to centrifuge work input and heat from the environment, to a holding drum, supplying the all liquid filtrate to an isomerization stage where the filtrate is reacted over a catalyst bed, separating para-xylene and mixed xylenes from impurities in a distillation stage and recycling the mixed xylenes to the crystallization stage.

Commonly assigned U.S. Pat. No. 5,004,860 issued Aug. 2, 1991 to John S. Hansen and William A. Waranius discloses a filter system which is coupled to a crystallizer in a liquid crystal separation unit and a method for using the same for extracting liquid from a liquid crystal slurry to enhance solid crystal recovery. More specifically, the patent relates to a filter system comprising porous metal tubes having very small porosity which are utilized in a closed feedback loop of liquid-crystal slurry for extracting liquid filtrate from the slurry and returning the higher crystal concentration slurry back to a crystallizer in a process for the extraction of para-xylene crystals from a mother liquor feed including mixed xylenes and impurities in liquid and crystal form.

Because it is usually preferred that fairly dry solids and clear liquid be separately discharged from opposite ends of the centrifuge bowl, the solids-liquid feed must be introduced into the pool of liquid at the middle portion of the bowl rather than near either end. Therefore, the solids-liquid feed is usually delivered into the conveyor from the distal end of a small stationary feed tube extended into the centrifuge along its rotational axis. Problems which persist with an extended stationary feed tube supported only near one end of the bowl include deflections and vibration of the cantilevered tube.

Due to changes in solids content of the feed during operation, variations in the weight of feed loading an extended stationary feed tube can cause significant deflections and vibrations of the tube and rotating parts of the centrifuge. Typically, even brief contact between, for example, the distal end of a small stationary tube and any rotating parts of the centrifuge is likely to be catastrophic to an extended stationary feed tube.

Solid deposits from the feed can form incrustations on an extended stationary feed tube to cause significant deflections, vibrations, and can even cause an avalanche of solids onto the conveyor or into the liquid pool which are rotating at high speeds. Such an avalanche is likely to cause a rapid increase in power required to drive the centrifuge which may subsequently be taken out of service for mechanical inspection and/or maintenance.

There remains, therefore, a current need for centrifugal apparatus which provides improved means for feeding solids-liquid mixtures which is effective in reducing the magnitude of mechanical vibration, reducing feed tube failures, and thereby avoiding interruptions in service.

Advantageously, such improved means of feeding solids-liquid mixtures would assist in acceleration of the mixtures up to rotating speed with decreased damage of the solid crystals, improving their recovery.

SUMMARY OF THE INVENTION

In broad aspect, the invention is that, in centrifugal decanters with a screw conveyor for the continuous separation of solids-liquid mixtures, the conveying means is provided with a coaxially mounted feed distributor, generally trunco-conical in form, adapted to distribute into the conveying means a solids-liquid feed stream falling into the distributor from a short, stationary feed tube.

In one aspect, the invention is improved apparatus for continuous separation of solids-liquid mixtures into separate components comprising an elongated bowl having an inner bowl surface, including liquid overflow ports, a cylindrical portion adapted to receive the solids-liquid mixtures, and a trunco-conical portion having a discharge port adapted to discharge solids separated from the mixture, the bowl being mounted for rotation about its horizontally disposed longitudinal axis, and a conveying means, including a trunco-conical portion and a cylindrical portion with an internal chamber in flow communication with the inner bowl surface through a plurality of feed passages, and at least one conveyor blade having a leading surface facing in the direction of the discharge port for solids and a distal edge, the conveyor blade being helically and coaxially mounted within the bowl through the length of the bowl surface with the distal edge of the conveyor blade in a closely spaced, sweeping relationship to the bowl surface, and means for rotating the bowl and the conveyor blade at a speed differential to contact the distal edge of the conveyor blade with the solids upon separation and propel the separated solids toward the solids discharge port, the improvement which comprises providing the conveying means with a coaxially mounted feed distributor of generally trunco-conical form adapted to distribute into the internal chamber a solids-liquid feed falling into the distributor from a short, stationary feed tube.

According to another aspect of the invention, a method is provided for extracting particulate solids from a feed slurry in a separation unit of the type which includes at least one centrifuge apparatus comprising an elongated bowl having an inner bowl surface including liquid overflow ports, a cylindrical portion adapted to receive the feed slurry, and a trunco-conical portion having a discharge port adapted to discharge particulate solids separated from the feed slurry, the bowl being mounted for rotation about its horizontally disposed longitudinal axis, and a conveying means, including a trunco-conical portion and a cylindrical portion with an internal mixture chamber in flow communication with the inner bowl surface through a plurality of feed passages, and at least one conveyor blade having a leading surface facing in the direction of the discharge port for solids and a distal edge, the conveyor blade being helically and coaxially mounted within the bowl through the length of the bowl surface with the distal edge of the conveyor blade in a closely spaced, sweeping relationship to the bowl surface, and means for rotating the bowl and the conveyor blade at a speed differential to contact the distal edge of the conveyor blade with the solids upon separation and propel the separated solids toward the solids discharge port, an improvement which comprises providing the conveying means with a coaxially mounted feed distributor of generally trunco-conical form adapted to distribute into the mixture chamber a solids-liquid feed stream falling into the distributor from a short stationary feed tube.

According to yet another aspect of the invention, a method is provided for extracting high purity solid para-xylene crystals from a mother liquor feed slurry of mixed xylenes in liquid and crystal form in a separation unit of the type which includes a crystallization stage where a feed of mixed xylenes in liquid form is cooled in at least one crystallizer to crystallize liquid para-xylene into solid crystals which are separated from the mother liquor feed slurry by centrifugation in at least one centrifuge apparatus, an isomerization stage where xylenes, such as ortho-xylene and meta-xylene, are reacted over a catalyst bed to convert these xylenes into para-xylene, and a distillation stage where the mixed xylenes are separated from the impurities,. wherein the centrifuge apparatus comprises an elongated bowl having an inner bowl surface including liquid overflow ports, a cylindrical portion adapted to receive the mother liquor feed slurry, and a trunco-conical portion having a discharge port adapted to discharge para-xylene solids separated from the mother liquor feed slurry, the bowl being mounted for rotation about its horizontally disposed longitudinal axis, and a conveying means, including a trunco-conical portion and a cylindrical portion with an internal mixture chamber in flow communication with the inner bowl surface through a plurality of feed passages, and at least one conveyor blade having a leading surface facing in the direction of the discharge port for solids and a distal edge, the conveyor blade being helically and coaxially mounted within the bowl through the length of the bowl surface with the distal edge of the conveyor blade in a closely spaced, sweeping relationship to the bowl surface, and means for rotating the bowl and the conveyor blade at a speed differential to contact the distal edge of the conveyor blade with the solids upon separation and propel separated solids toward the solids discharge port, the improvement which comprises providing the conveying means with a coaxially mounted feed distributor of generally trunco-conical form adapted to distribute into the chamber a mother liquor feed slurry falling into the distributor from a short stationary feed tube.

In centrifuge apparatus of the invention the short, stationary feed tube terminates concentrically with the tapered internal feed distributor at a distal end of the tube. The distal end of the improved tube is advantageously located no more than ⅓ of the length of the bowl from one end thereof. The distal end of the improved tube is preferably located no more than ¼ of the length of the bowl from one end thereof, and more preferably is located no more than ⅕ of the length of the bowl from one end thereof. In a preferred class of the invention the distal end is within the convergent trunco-conical portion of the bowl.

According to the invention extension of the feed tube into the tapered internal feed distributor is limited to less than about 50 percent of the length of the distributor. Extension of the feed tube into the tapered internal feed distributor is preferably limited to less than about 30 percent, and more preferably to about 10 percent of the length of the distributor.

For a more complete understanding of the present invention, reference should now be made to the embodiments illustrated in greater detail in the accompanying drawings and described below by way of examples of the invention.

DESCRIPTION OF THE DRAWINGS

The appended claims set forth those novel features which characterize the present invention. The present invention, as well as advantages thereof, may best be understood by reference to the following brief description of preferred embodiments taken in conjunction with the annexed drawings, in which:

In the drawings like characters designate like or corresponding parts throughout the several views. Auxiliary valves, lines and equipment not necessary for an understanding of the invention have been omitted from the drawings.

DESCRIPTION OF THE INVENTION

In operation of a solid-bowl centrifuge decanter with a screw conveyor, a solids-liquid feed is introduced into the bowl, where, due to centrifugal force effected by rotation of the bowl, heavier and lighter components of the feed slurry separate. The heavier solids move outward in a pool of the lighter liquid phase, forming a layer of sedimented solids adjacent to the bowl's inner surface. Since the bowl and screw conveyor are rotated at different speeds, typically controlled by a predetermined conveyor gear ratio, solids sedimented against the inner surface of the bowl are conveyed by the conveyor's blade along an annular space inside of the bowl's inner surface toward the trunco-conical end of the bowl where the sedimented solids are conveyed out of the liquid pool and discharged from one or more ports at the trunco-conical end of the bowl.

Figure 1:
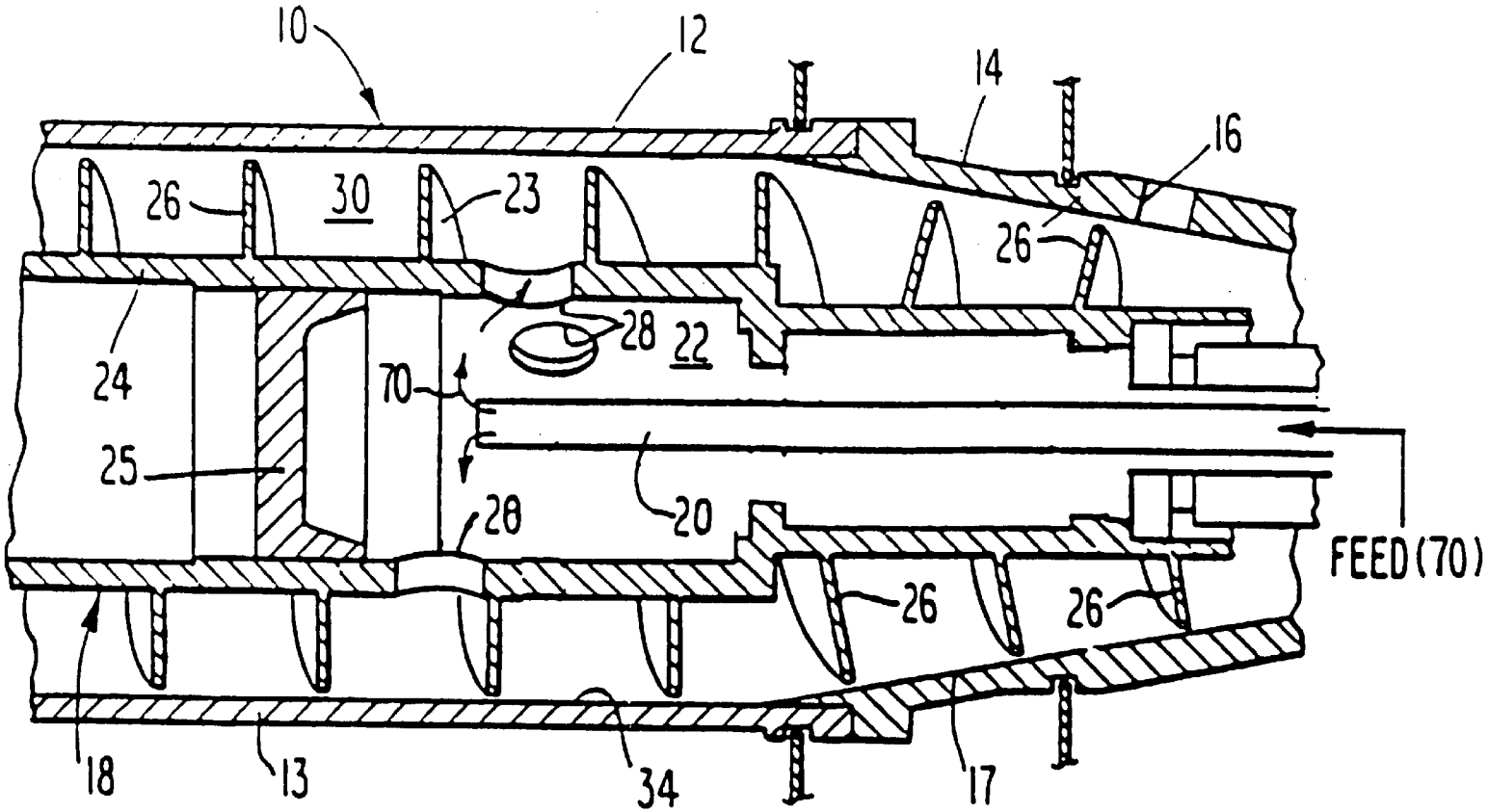
PRIOR ART Fig. 1
FIG. 1 is a fragmentary, longitudinal sectional view of a prior art solid bowl centrifuge taken through the rotational axis of the centrifuge and cantilevered feed conduit.

Referring to FIG. 1, centrifuge apparatus 10 comprises an axially elongated, imperforate bowl 12 of annular cross-section which receives the solids-liquid mixture. Bowl 12 is adapted for rotation about a longitudinal axis. In addition to a main portion 13 of generally cylindrical shape, bowl 12 includes a tapered or convergent end portion 14 of generally trunco-conical form. The inner surface 34 of end portion 14 of bowl 12 gradually decreases in diameter toward a solids discharge port 16, the inner surface 34 of the bowl thus providing a drying "beach" 17 for solids moving toward port 16 and out of the liquid pool, or pond (not shown) created by the centrifugal action when apparatus 10 is in use.

Coaxially mounted within bowl 12 is a helical screw conveyor 18, comprising hub 24 on which is mounted a blade 26. The blade is helically formed and has a plurality of turns or revolutions. Conveyor 18 is rotatably mounted on a common axis with bowl 12 and is adapted to be driven at a speed slightly different from that of bowl 12. As a result of the speed differential, solids are conveyed in the axial direction by contact with the leading surface of blade 26. Generally, in operation, the differential speed of the conveyor with respect to the bowl is preselected. The relative speed of the conveyor, however, may be a variable and can be controlled.

The solids-liquid mixture 70 is delivered as a feed stream to the interior of centrifuge 10 through a stationary feed tube 20. Cantilevered feed tube 20 projects in an axial direction and terminates within the main portion 13 of bowl 12, concentrically with feed chamber 22 defined by the interior of hub 24 and target disc 25. Feed introduced into feed chamber 22 exits radially therefrom through feed passages 28 into separation chamber 30, disposed between the outer surface of hub 24 and the inner surface of bowl 12. Effluent is discharged through liquid discharge openings (not shown).

The outwardly projecting, helically formed blade 26 has a leading surface 23 facing in the direction of discharge port 16. The distal edge of blade 26 is shaped to conform to the inner surface 34 of bowl 12 such that, upon rotation of conveyor 18, the distal edge of blade 26 is closely spaced to inner surface 34 and in sweeping relationship thereto. In operation, that part of leading surface 23 of blade 26, which is contiguous to the distal portion of blade 26, provides a working surface which contacts the solids separating from the feed due to the combined centrifugal force and the relative rotational movement of conveyor 18 and bowl 12.

Figure 2:
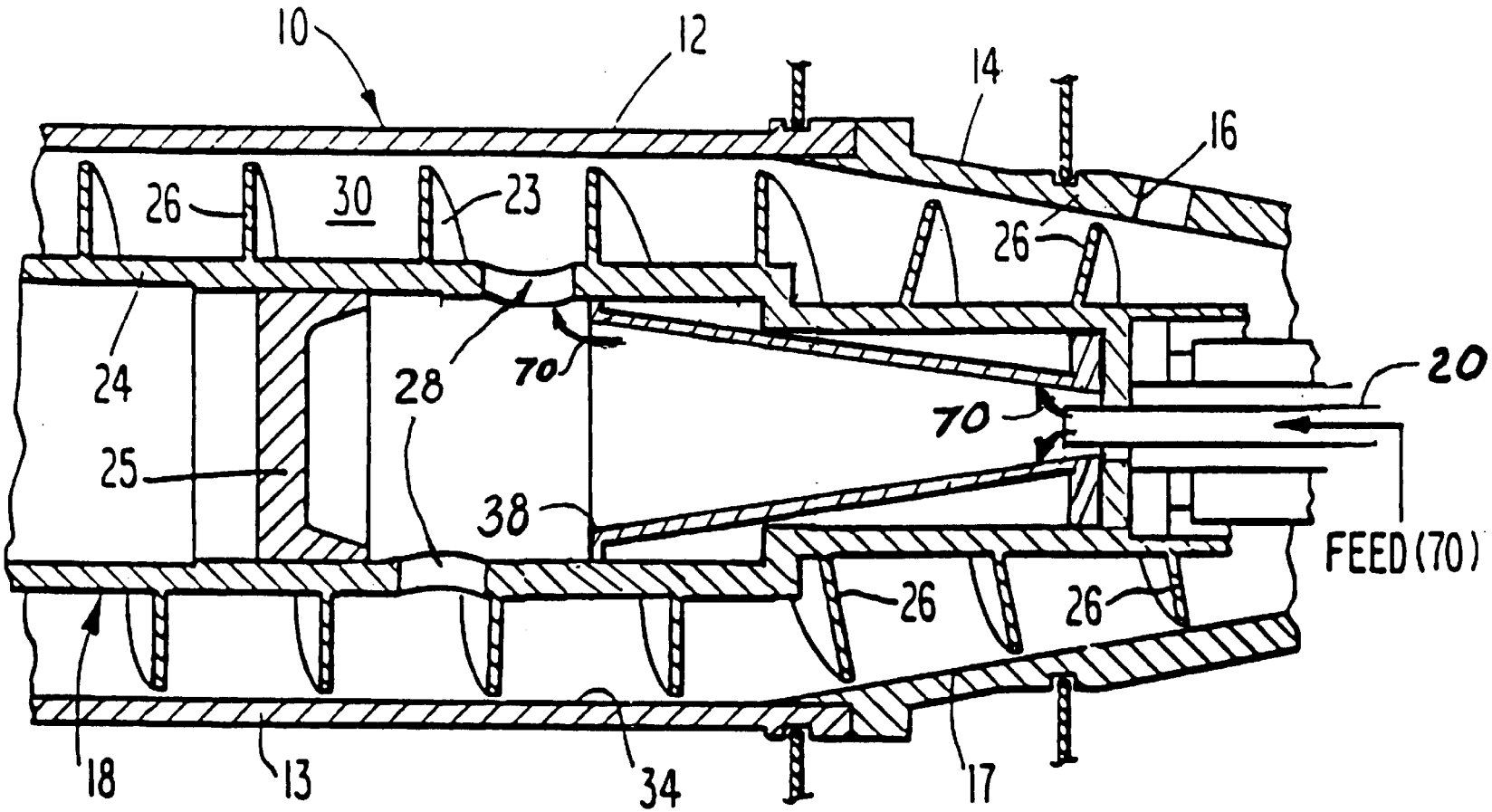
FIG. 2 is a view of the centrifuge of FIG. 1, modified to incorporate the present invention.

FIG. 2 is a view of the centrifuge of FIG. 1, modified in accordance with an embodiment of the present invention. Conveyor 18 is provided with a tapered feed distributor 38, generally trunco-conical in form, coaxially mounted within hub 24. Feed distributor 38 has a base adapted to the interior of hub 24 within feed chamber 22, and a top adapted to receive feed 70 from the distal end of tube 20. Stationary feed tube 20 terminates, according to the present invention, within the convergent end portion 14 of bowl 12, concentrically of tapered internal feed distributor 38. The tapered feed distributor 38 has an entry throat in which the distal end of the feed tube 20 is placed. The conveyor 18 has an end wall 21 located within the trunco-conical portion 14 of the bowl 12 and the conveyor end wall 21 abuts a mounting flange 36 of the internal feed distributor 38 as shown in FIG. 2. The feed tube 20 extends through the end wall 21 and the feed tube 20 has a distal end proximate the conveyor end wall 21 the entry throat of the tapered feed distributor 38 as best shown in FIG. 2.

Figure 3:
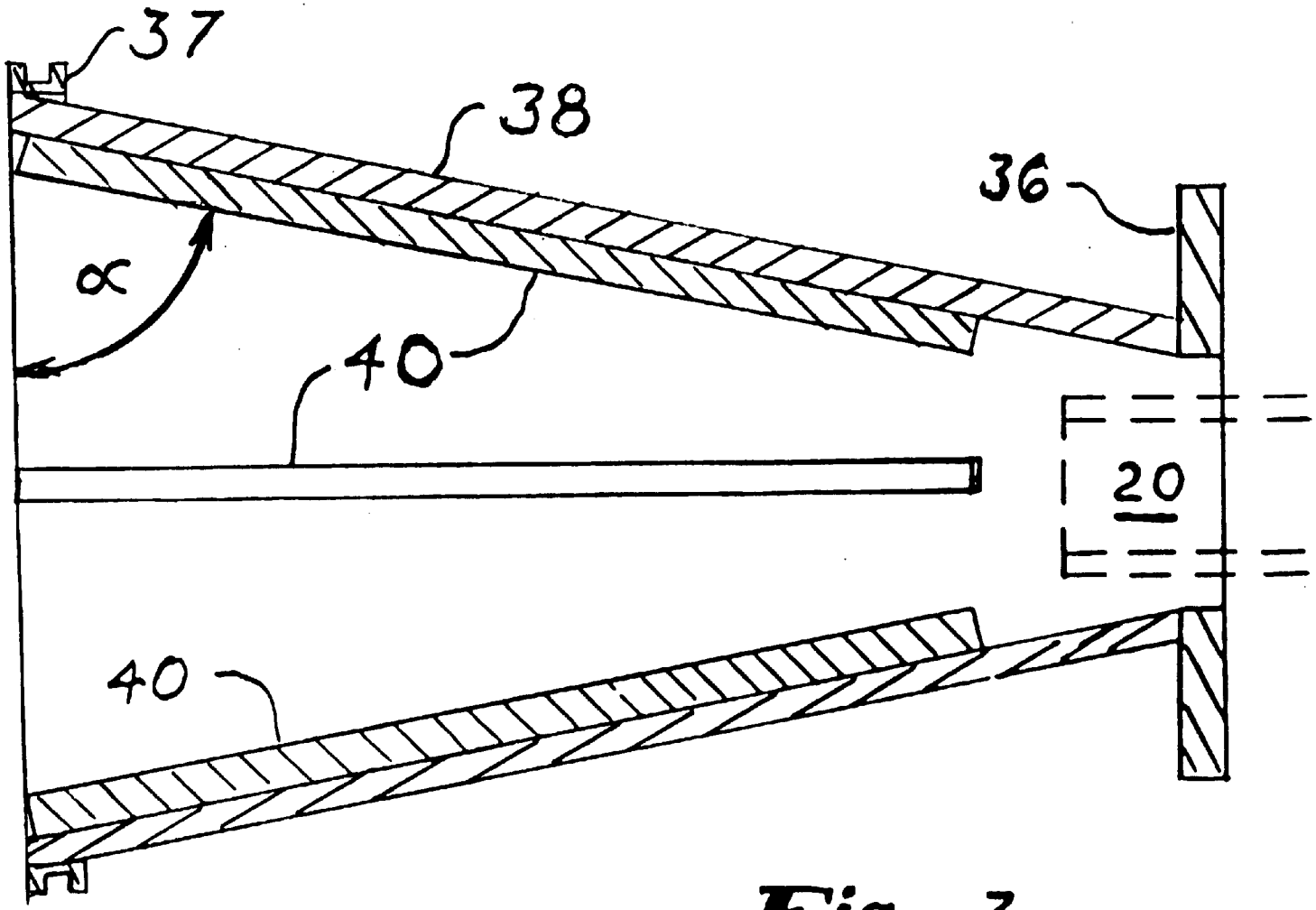
FIG. 3 is a longitudinal sectional view, drawn to larger scale, of the feed distributor of FIG. 2.

FIG. 3 is a longitudinal sectional view drawn to larger scale of the internal feed distributor of FIG. 2. Distributor 38 includes, at its top, mounting flange 36, and seal ring 37 at its base. Taper of the generally trunco-conical form is at an angle $\alpha$, which is measured from the base. Advantageously, internal feed distributors of the present invention are provided with a plurality of internal flights 40 adapted to accelerate feed slurry falling from a stationary feed tube 20 onto a rotating distributor. Preferably, feed slurry is substantially at the rotary speed of the conveyor when the slurry reaches the feed chamber. As a result, turbulence is mitigated in the pond when it is reached by the slurry, and separation of solids from liquid thus improved.

Useful embodiments of the present invention comprise an internal feed distributor with a taper at an angle $\alpha$ in a range of up to about 80 degrees, preferably a taper in a range from about 45 degrees to about 80 degrees, more preferably in a range from about 60 degrees to about 75 degrees. The centrifuge bowl is adapted to operate at speeds in a range upward from about 1000 rpm, preferably in a range from about 1500 rpm to about 4000 rpm.

Improved screw conveyor centrifugal apparatus for separation of solids-liquid mixtures, according to this invention, is particularly useful for separation of solids-liquid feed containing up to about 60 weight percent solids, preferably from about 15 to about 55 weight percent solids.

For some particular applications it has been found desirable to provide the bowl with a perforated cylindrical extension at the tapered end to allow for additional drainage and/or internal rinsing of the solids after they have been scrolled out of the liquid pool, but prior to their discharge.

In other applications it is advantageous to reslurry discharged solids and centrifuge the resulting mixture.

Centrifugal apparatus with a tapered internal feed distributor, according to this invention, can advantageously include means for internal washing of sedimented solids in both solid-bowl and screen-bowl centrifuges. See, for example, commonly assigned U.S. Pat. No. 5,653,673, issued Aug. 5, 1997, which patent is specifically incorporated in herein its entirety by reference.

Any suitable wash ratio can be used. Typically, wash ratios are in a range downward from about 5 pounds of washing liquid per pound of solids, preferably in a range downward from about 2 pounds of washing liquid per pound of solids, and more preferably in a range from about 0.2 to about 2 pounds of washing liquid per pound of solids. The leading surface of at least one helically and coaxially mounted conveyor blade optionally has a curvilinear shape adapted in use to plow over sedimented solids in the beach section.

The following examples will serve to illustrate certain specific embodiments of the invention disclosed herein. These examples should not, however, be construed as limiting the scope of the novel invention, as there are many variations which may be made thereon without departing from the spirit of the disclosed invention, as those of skill in the art will recognize.

EXAMPLES

GENERAL

Solids-liquid separations in the following examples were carried out using a 36-inch diameter by 8-foot centrifuge apparatus with a screw conveyor, including a trunco-conical portion and a cylindrical portion with an internal chamber in flow communication with the inner bowl surface through a plurality of feed passages through which a solids-liquid feed was introduced into the pool of liquid at the middle portion of the bowl.

The solids-liquid feed used in these examples contained about 15 weight percent solids with a specific gravity of 1.05 in mixed xylene with specific gravity of 0.9. Average particle size of the solids varied from about 75 to about 150 microns.

Comparative Example

In his example, a 36-inch diameter by 8-foot centrifuge was equipped with a slurry feed tube, supported as a long cantilever, which terminated concentrically of the internal chamber in the conveyor at a distal end of the tube, which was about 13/32 of the bowl length from support at the solids discharge end of the bowl.

A series of runs was carried out at rotating speeds of 1600 rpm and 1400 rpm. At the higher speed of rotation, frequency of mechanical interference of the stationary feed tube with the rotating conveyor, and/or power surges which also shut down the machine, were causing additional operating costs. While operation at the lower speed of rotation may have increased the time between mechanical failures, the reduction in speed clearly caused a deleterious reduction in product purity.

Example of the Invention

In this example, the conveyor in a 36-inch diameter by 8-foot centrifuge was provided with a coaxially mounted feed distributor of trunco-conical form, tapered at an angle $\alpha$ which was about 73 degrees. The distributor was provided with four internal flights, as shown in FIG. 3, to accelerate feed slurry falling from a short stationary feed tube onto a rotating distributor.

The stationary feed tube terminated concentrically of the tapered internal feed distributor at a distal end of the tube, which distal end was about 1/20 of the length of the bowl from support at the solids discharge end of the bowl.

A series of runs was carried out at rotating speeds of 1400 rpm and 1600 rpm. During about 100 days of testing these experimental runs demonstrated improved operation. There was no shut down of the machine due to mechanical interference of the stationary feed tube with the rotating conveyor, and the time between power surges which shut down the machine was greatly increased. At the higher speed of rotation, increases in product purity were also demonstrated.

That which is claimed is:

1. In a centrifuge apparatus for continuous separation of solids-liquid mixtures into separate components comprising an elongated bowl having an inner bowl surface, including liquid overflow ports, a cylindrical portion adapted to receive the solids-liquid mixtures, and a trunco-conical portion having a discharge port adapted to discharge solids separated from the mixture, the bowl being mounted for rotation about its horizontally disposed longitudinal axis, and a conveying means including a trunco-conical portion and a cylindrical portion with an internal chamber in flow communication with the inner bowl surface through a plurality of feed passages, the conveying means including at least one conveyor blade having a leading surface facing in the direction of the discharge port for solids and a distal edge, the conveyor blade being helically and coaxially mounted within the bowl through the length of the bowl surface with the distal edge of the conveyor blade in a closely spaced, sweeping relationship to the bowl surface and means for rotating the bowl and the conveyor blade at a speed differential to contact the distal edge of the conveyor blade with the solids upon separation and propel separated solids toward the solids discharge port, the improvement which comprises providing the conveying means with a feed means for reducing the magnitude of mechanical vibration of the centrifuge apparatus comprising a coaxially mounted internal feed distributor of generally trunco-conical form tapering at an angle $\alpha$ in a range of from about 45 degrees to about 80 degrees, said internal feed distributor having an entry throat and having a plurality of internal flights adapted to accelerate and distribute into the conveying means a feed stream of said solids-liquid mixtures falling into the rotating internal feed distributor from a short, stationary feed tube during continuous separation of solids-liquid mixtures, said conveyor having an end wall located within the trunco-conical portion of the bowl, said conveyor end wall abutting a mounting flange of said internal feed distributor, said feed tube extending through said end wall, said feed tube having a distal end proximate said conveyor end wall and said entry throat.

2. The centrifuge apparatus according to claim 1 wherein the stationary feed tube terminates concentrically of the tapered internal feed distributor at the distal end of the tube.

3. The centrifuge apparatus according to claim 1 wherein the internal feed distributor is tapered at an angle $\alpha$ in a range of from about 60 degrees to about 75 degrees.

4. The centrifuge apparatus according to claim 3 wherein the stationary feed tube terminates concentrically of the tapered internal feed distributor at the distal end of the tube.

5. In a method for extracting particulate solids from a feed slurry in a separation unit of the type which includes at least one centrifuge apparatus comprising an elongated bowl having an inner bowl surface, including liquid overflow ports, a cylindrical portion adapted to receive the feed slurry, and a trunco-conical portion having a discharge port adapted to discharge particulate solids separated from the feed slurry, the bowl being mounted for rotation about its horizontally disposed longitudinal axis, and a conveying means, including a trunco-conical portion and a cylindrical portion with an internal chamber in flow communication with the inner bowl surface through a plurality of feed passages, the conveying means including at least one conveyor blade having a leading surface facing in the direction of the discharge port for solids and a distal edge, the conveyor blade being helically and coaxially mounted within the bowl through the length of the bowl surface with the distal edge of the conveyor blade in a closely spaced, sweeping relationship to the bowl surface, and means for rotating the bowl and the conveyor blade at a speed differential to contact the distal edge of the conveyor blade with the solids upon separation and propel the separated solids toward the solids discharge port, the improvement which comprises providing the conveying means with a feed means for reducing the magnitude of mechanical vibration of the centrifuge apparatus comprising a coaxially mounted internal feed distributor of generally trunco-conical form tapering at an angle $\alpha$ in a range of from about 45 degrees to about 80 degrees, said internal feed distributor having an entry throat and having a plurality of internal flights adapted to accelerate and distribute into the conveying means a feed stream of said feed slurry falling into the rotating internal feed distributor from a short, stationary feed tube during continuous separation of solids-liquid mixtures, said conveyor having an end wall located within the trunco-conical portion of the bowl, said conveyor end wall abutting a mounting flange of said internal feed distributor, said feed tube extending through said end wall, said feed tube having a distal end proximate said conveyor end wall and said entry throat.

6. The method for extracting particulate solids of claim 5 wherein the feed stream is an aqueous slurry comprising carbonaceous material in particulate form.

7. The method for extracting particulate solids of claim 5 wherein the feed stream is an aqueous slurry comprising coal in particulate form.

8. The method for extracting particulate solids of claim 5 wherein the feed stream is an aqueous slurry comprising an aromatic polycarboxylic acid in particulate form.

9. The method for extracting particulate solids of claim 5 wherein the feed stream is a slurry comprising an aromatic acid selected from the group consisting of terephthalic acid formed by the oxidation of para-xylene, isophthalic acid formed by the oxidation of meta-xylene, and 2,6-naphthalene dicarboxylic acid formed by the oxidation of a 2,6-dialkylnaphthalene.

10. The method for extracting particulate solids of claim 5 wherein the feed stream is an aqueous slurry comprising terephthalic acid formed by the oxidation of high purity para-xylene.

11. The method for extracting particulate solids according to claim 5 wherein the internal feed distributor is tapered at an angle $\alpha$ in a range of from about 60 degrees to about 75 degrees.

12. The method for extracting particulate solids according to claim 11 wherein the stationary feed tube terminates concentrically of the tapered internal feed distributor at the distal end of the tube.

13. The method for extracting particulate solids according to claim 5 wherein the stationary feed tube terminates concentrically of the tapered internal feed distributor at the distal end of the tube.

14. In a method for extracting high purity solid para-xylene crystals from a mother liquor feed slurry of mixed xylenes in liquid and crystal form in a separation unit of the type which includes a crystallization stage where a feed of mixed xylenes in liquid form is cooled in at least one crystallizer to crystallize liquid para-xylene into solid crystals which are separated from the mother liquor feed slurry by centrifugation in at least one centrifuge apparatus, an isomerization stage where xylenes, such as ortho-xylene and meta-xylene, are reacted over a catalyst bed to convert these xylenes into para-xylene, and a distillation stage where the mixed xylenes are separated form the impurities, wherein the centrifuge apparatus comprises an elongated bowl having an inner bowl surface including liquid overflow ports, a cylindrical portion adapted to receive the mother liquor feed slurry, and a trunco-conical portion having a discharge port adapted to discharge of para-xylene solids separated from the mother liquor feed slurry, the bowl being mounted for rotation about its horizontally disposed longitudinal axis, and a conveying means including a trunco-conical portion and a cylindrical portion with an internal chamber in flow communication with the inner bowl surface through a plurality of feed passages, the conveying means including at least one conveyor blade having a leading surface facing in the direction of the discharge port for solids and a distal edge, the conveyor blade being helically and coaxially mounted within the bowl through the length of the bowl surface with the distal edge of the conveyor blade in a closely spaced, sweeping relationship to the bowl surface, and means for rotating the bowl and the conveyor blade at a speed differential to contact the distal edge of the conveyor blade with the solids upon separation and propel the separated solids toward the solids discharge port, the improvement which comprises providing the conveying means with a feed means for reducing the magnitude of mechanical vibration of the centrifuge apparatus comprising a coaxially mounted internal feed distributor of generally trunco-conical form tapering at an angle $\alpha$ in a range of from about 45 degrees to about 80 degrees, said internal feed distributor having an entry throat and having a plurality of internal flights adapted to accelerate and distribute into the conveying means the mother liquor feed slurry stream falling into the rotating internal feed distributor from a short, stationary feed tube during continuous separation of para-xylene solids from the mother liquor feed slurry, said conveyor having an end wall located within the trunco-conical portion of the bowl, said conveyor end wall abutting a mounting flange of said internal feed distributor, said feed tube extending through said end wall, said feed tube having a distal end proximate said conveyor end wall and said entry throat.

15. The method for extracting according to claim 14 wherein the internal feed distributor is tapered at an angle $\alpha$ in a range of from about 60 degrees to about 75 degrees.

16. The method for extracting according to claim 15 wherein the stationary feed tube terminates concentrically of the tapered internal feed distributor at the distal end of the tube.

17. The method for extracting according to claim 14 wherein the stationary feed tube terminates concentrically of the tapered internal feed distributor at the distal end of the tube.

* * * * *

UNITED STATES PATENT AND TRADEMARK OFFICE
CERTIFICATE OF CORRECTION

PATENT NO.: 5,971,907

DATED: Oct. 26, 1999

INVENTOR(S): John A. Johannemann, Richard C. Albano, Gaines L. Brewer

It is certified that error appears in the above-identified patent and that said Letters Patent is hereby corrected as shown below:

| Col. | Line | |
|---|---|---|
| 2 | 7 | "Shapiro, 4,731,182"<br><br>should read:<br>"Shapiro; 4,731,182" |
| 5 | 3 | "mixtures which is effective"<br><br>should read:<br>"mixtures and is effective" |
| 6 | 19 | "the impurities,. wherein"<br><br>should read:<br>"the impurities, wherein" |
| 7 | 48 | "liquid pool, or pond"<br><br>should read:<br>"liquid pool or pond" |

UNITED STATES PATENT AND TRADEMARK OFFICE
CERTIFICATE OF CORRECTION

PATENT NO.: 5,971,907

DATED: Oct. 26, 1999

INVENTOR(S): John A. Johannemann, Richard C. Albano, Gaines L. Brewer

It is certified that error appears in the above-identified patent and that said Letters Patent is hereby corrected as shown below:

| Col. | Line | |
|---|---|---|
| 9 | 45 | "In his example,"<br><br>should read:<br>"In this example," |
| 12 | 15 | "separated form the impurities,"<br><br>should read:<br>"separated from the impurities" |

Signed and Sealed this

Fifth Day of September, 2000

*Attest:*

*Attesting Officer*

Q. TODD DICKINSON

*Director of Patents and Trademarks*